US006397400B1

(12) United States Patent
Hassler et al.

(10) Patent No.: US 6,397,400 B1
(45) Date of Patent: Jun. 4, 2002

(54) BODY PROTECTION/SUPPORT DEVICE

(75) Inventors: Andreas Hassler, Rohrdorf; Herbert Boerger, Wilhelmsdorf, both of (DE)

(73) Assignee: Oped GmbH-Orthopädischc Produkte (DE)

( * ) Notice: Subject to any disclaimer, the term of this patent is extended or adjusted under 35 U.S.C. 154(b) by 0 days.

(21) Appl. No.: 09/485,016

(22) PCT Filed: Jul. 27, 1998

(86) PCT No.: PCT/DE98/02103

§ 371 (c)(1),
(2), (4) Date: Apr. 11, 2000

(87) PCT Pub. No.: WO99/06126

PCT Pub. Date: Feb. 11, 1999

(30) Foreign Application Priority Data

Jul. 29, 1997 (DE) ..... 197 32 610

(51) Int. Cl.[7] ..... A41D 13/00
(52) U.S. Cl. ..... 2/455; 602/5
(58) Field of Search ..... 2/455, 463–465, 2/467, 2.5, 5, 6.1, 410–415, 425, 468, 22, 24, 44, 45, 46, 16, 909, 911, 918, DIG. 3; 128/878, 882, DIG. 20; 602/5, 6, 17, 19, 23, 62

(56) References Cited

U.S. PATENT DOCUMENTS

| | | | | | |
|---|---|---|---|---|---|
| 3,745,998 | A | * | 7/1973 | Rose | 128/89 R |
| 4,412,358 | A | * | 11/1983 | Lavender | 2/412 |
| 4,657,003 | A | * | 4/1987 | Wirtz | 128/133 |
| 4,848,364 | A | * | 7/1989 | Bosman | 128/849 |
| 5,086,514 | A | * | 2/1992 | Ross | 2/456 |
| 5,222,478 | A | * | 6/1993 | Scarberry et al. | 128/30.2 |
| 5,324,460 | A | * | 6/1994 | Briggs | 2/411 |
| 6,065,158 | A | * | 5/2000 | Rush | 2/412 |

FOREIGN PATENT DOCUMENTS

| | | |
|---|---|---|
| CH | 577 328 | 7/1976 |
| DE | 1 376 177 | 10/1975 |
| DE | 195 24 743 A1 | 1/1996 |
| DE | 296 11 929 U1 | 10/1996 |

* cited by examiner

*Primary Examiner*—John J. Calvert
*Assistant Examiner*—Tejash Patel
(74) *Attorney, Agent, or Firm*—McGlew and Tuttle, P.C.

(57) ABSTRACT

A body protection/support device is provided for arrangement on a body part. The device has a molded body filling of individual molded bodies (19, 20) accommodated in a receiving enclosure (11). The receiving enclosure (11) in an outer part (13) is substantially remote from the body part and is relatively rigid compared to an inner part (12), which is substantially directed towards the body part.

19 Claims, 3 Drawing Sheets

BODY PROTECTION/SUPPORT DEVICE

FIELD OF THE INVENTION

The present invention relates to a body protection/support device for arrangement on a body part, having a molded body filling of individual molded bodies accommodated in a receiving enclosure.

BACKGROUND OF THE INVENTION

A body protection/support device of the type described initially is known from DE 296 11 929 U1. The known device comprises a molded body filling of individual resilient molded bodies in a receiving enclosure in the form of a foil pouch and is used for integration into so-called protectors, which are used as shin guards, elbow guards, safety helmets etc. to protect against sports injuries.

With the known device, the intended protective effect may be achieved only through combination with the protector, which is designed as a separate component and, unlike the dimensionally compliant foil pouch, has the form of an impact-resistant plastic shell.

SUMMARY AND OBJECTS OF THE INVENTION

The object of-the present invention is to propose a body protection/support device which compared to the known devices, is of a one-piece construction.

According to the invention, a body protection/support device for arrangement on a body part is provided. The device comprises a receiving enclosure and a molded body filling. The molded body filling is made of individual molded bodies accommodated in the receiving enclosure. The receiving enclosure has an outer part substantially remote from the body part. The outer part is relatively rigid compared to an inner part, which is substantially directed towards the body part.

In the case of the device according to the invention, by virtue of the—in terms of its dimensional stability—differentiated receiving enclosure the supporting "shell function", which is achieved in the known device by an additional component, is realized quasi integrally in the receiving enclosure. It is therefore possible for the first time to propose a body protection/support device, which enables the desired protective function without the need for combination of the receiving enclosure with a further component, namely the protector shell. This not only enables a considerable improvement in terms of inexpensive manufacture of such a protection device but also increases the reliability of such devices under load conditions because the protection device according to the invention eliminates the problem presented by the known protection devices, namely of reliably maintaining the connection between the outer protector shell and the receiving enclosure also under load conditions.

In a preferred embodiment of the body protection/support device it is proposed, in order to achieve the differentiated dimensional stability between the outer part directed towards the load side and the inner part directed towards the body part, to make the outer part and the inner part of the receiving enclosure from a common base material so that they verge continuously one into the other and, in order to form the differing degrees of stability, to provide the outer part and the inner part with differing material admixtures and/or use a base material which has been subjected to different material treatment in the region of the outer part and in the region of the inner part.

Thus, for example, it is possible to incorporate into the region of the base material intended for the outer part of the receiving enclosure materials which mechanically reinforce the base material, such as glass fibers, carbon fibers, aramide fibers, natural fibers, synthetic fibers, also in the form of two-dimensional formed bodies, and to leave the region of the base material intended for the inner part in its original state. It is also possible to achieve differing degrees of material stability in the region of the outer part and of the inner part of the receiving enclosure by subjecting the corresponding regions to differing heat treatment.

In a further preferred embodiment of the body protection/support device, the outer part and the inner part of the receiving enclosure are made of different materials.

In such a case it is particularly advantageous to use, for forming the outer part and the inner part, at least two material layers which are connected to one another in a transition region in order to form the receiving enclosure.

As a connection of the material layers in the transition region a cohesive connection, i.e. a glued or welded joint for example, is particularly advantageous.

Particularly good results, in terms of a cohesive connection of the material layers in the transition region which is stable under load and inexpensive to manufacture, are achievable by means of a so-called "thermobondod joint", whereby overlapping edge regions of the material layers are pressed against one another under the influence of temperature.

An integration of the shell function into the receiving enclosure, which is particularly advantageous and in terms of its protective effect and stability under load matches an outer, separate protector shell, is enabled when at least the outer part of the receiving enclosure takes the form of a molded part having a dimensionally stable wall.

It is also possible to provide both the outer part and the inner part with a dimensionally stable wall, wherein the inner part, to enable it to adapt its shape to the body part it is to cover, is preferably less dimensionally stable than the outer part of the receiving enclosure.

A construction of the body protection/support device which is particularly advantageous in terms of the desired body protection function and from the point of view of wearing comfort is achieved when the outer part has a dimensionally stable wall and the inner part is provided with a dimensionally compliant wall.

In order to achieve a snug fit against the body part to be covered, which as a rule comprises a spherical surface, the body protection/support device may be designed in such a way that the outer part and the inner part form an, on the whole, cup-like receiving enclosure.

For covering particular regions or parts of the body, an, on the whole, annular construction of the receiving enclosure formed by the outer part and the inner part also proves advantageous. This applies particularly, when the body protection/support device is intended for use on the knee or head of a person. The annular construction of the receiving enclosure moreover affords particularly advantageous ventilation possibilities which further increase wearing comfort.

An embodiment which is particularly advantageous in terms of a further increase of wearing comfort as well as the adaptation, which alleviates the effects of external loads, of the inner part to the contour of the body part to be covered is enabled when, given a dimensionally compliant construction of the inner part, there is a vacuum, i.e. a low pressure relative to the ambient pressure, in the interior space of the receiving enclosure. There are various possibilities available for generating, said vacuum, wherein particularly given the arrangement of a non-return valve, which penetrates the receiving enclosure, the vacuum may be generated by the wearer himself before or as he puts on the body protection/support device. In many cases it may even be sufficient to provide a facility for evacuating the interior space of the receiving enclosure as the body protection/support device is put on, so that the inner part may be adapted to the contour of the body part to be covered without the dimensional state of the molded body filling achieved thereby having to be frozen by means of a vacuum, i.e. the evacuation serves merely to facilitate adaptation and, once adaptation his been effected, aeration is possible once more. The presence of a vacuum or the generation of a vacuum as the body protection/support device is put on does however have the advantage in terms of wearing comfort that, when the device is put on or positioned, a force directed away from the body part is generated, which allows the inner part to be adapted far more comfortably to the body part.

In a particularly advantageous manner, the body protection/support device may be used as a splint device on a body part. With said type of use, the protective function is secondary to the support function which is needed, for example, to splint a bone fracture or support a joint. In said case, the dimensionally stable, load-bearing support structure of the outer part then performs the actual splint function and the dimensionally compliant design of the inner part directed towards the relevant body part, through adaptation to the body contour, performs the function of padding and/or uniform distribution of the force of the pressure introduced by the supporting outer part into the body part.

A use of the body protection/support device as a head protection device likewise proves particularly advantageous. In said case, it is namely possible not only, as described in detail initially, to dispense with a separate protector shell connected to the actual receiving enclosure and achieve a simplified construction but also, through integration of the protector shell function in the outer part of the receiving enclosure, to achieve a particularly lightweight design of a head protection device. Said advantageous effect may be further enhanced by selecting the previously described annular construction of the receiving enclosure for the use as a head protection device.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
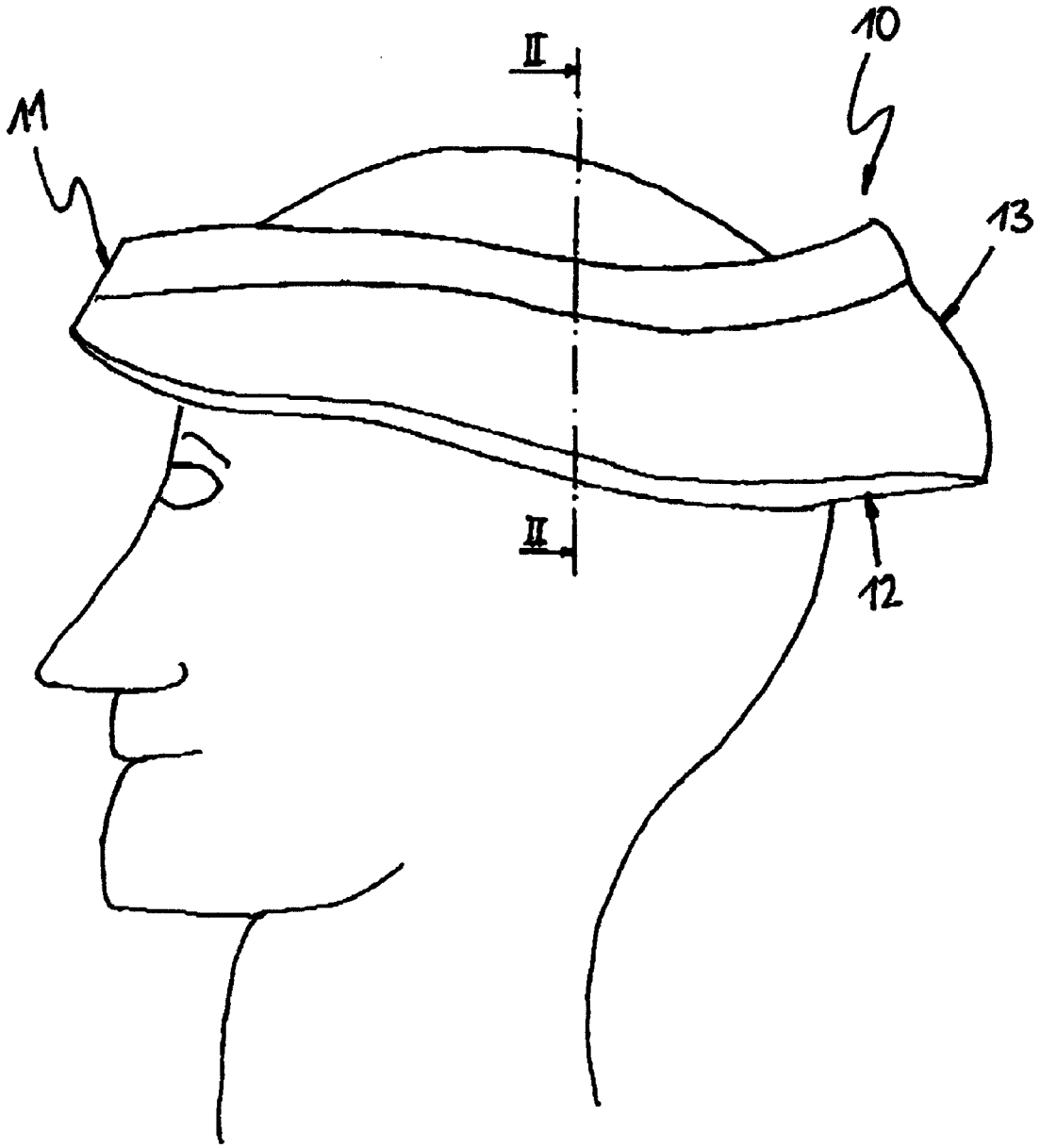
FIG. 1 a side view of a body protection/support device in an embodiment as a head protection device.

Referring to the drawings in particular, FIG. 1 shows a body protection/support device in an embodiment as a head protection device 10 which, in order to illustrate the arrangement on the head of a person wearing the head protection device 10, is shown arranged on a head. The type of head protection device 10 illustrated in FIG. 1 is a lightweight crash helmet for cyclists having an, on the whole, annular receiving enclosure 11 which comprises an inner part 12 and an outer part 13.

Figure 2:
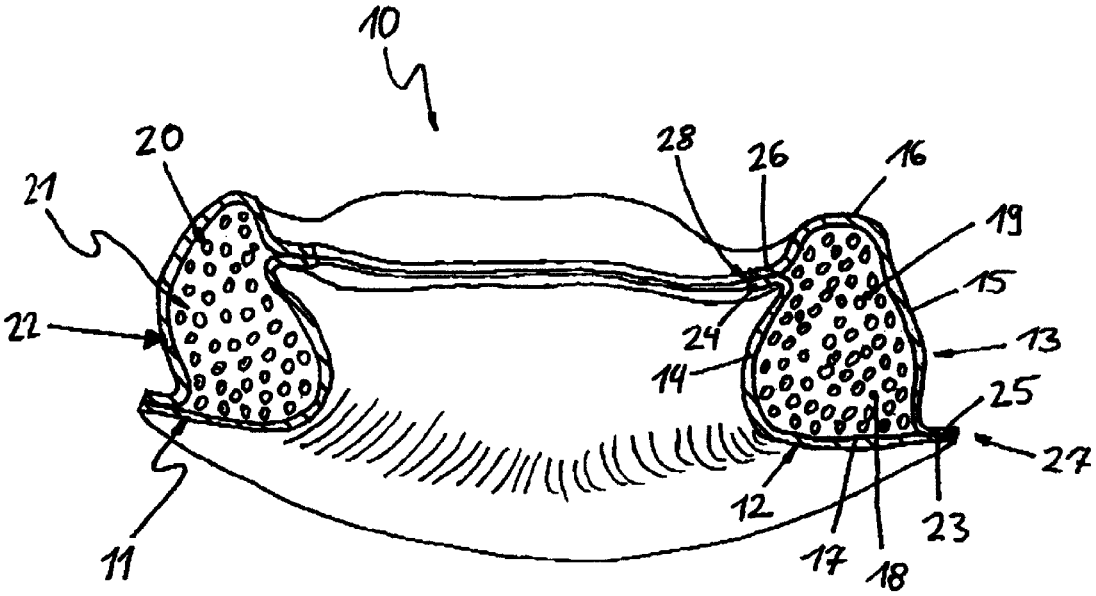
FIG. 2 the head protection device shown in FIG. 1 in section along the lines II—II in FIG. 1.

As is evident from the representation according to FIG. 2, which shows the receiving enclosure 11 with a receiving enclosure cross section 21 in a sectional view, the inner part 12 and the outer part 13 each comprise a material layer 14, 15, which is cut to size in accordance with the intended annular shape of the receiving enclosure 11. In such a case, as is particularly evident from a combined inspection of FIGS. 1 and 2, the material layer 15 forming the outer part 13 is situated in the outwardly directed region of the receiving enclosure 11 which comes into contact with an obstacle in the event of the wearer of the head protection device 10 being involved in a crash. The outer part 13 formed by the material layer 15 takes the form of a molded part having a dimensionally stable wall 16, whereas the inwardly directed material layer 14, which comes into contact with the head of the wearer of the head protection device 10, forms a—compared to the material layer 15—dimensionally compliant wall 17, which in the present cast may moreover be flexible and enables snug contact between the wall 17 and the head.

Like the outer part 13, the inner part 12 in the present cast also takes the form of a molded part.

Situated in an interior space 18 of the receiving enclosure 11 delimited by the outer part 13 and the inner part 12 is a molded body filling 19 of individual molded bodies 20, which in the present case are disposed so as to be movable relative to one another in the interior space 18. The molded bodies 20 may, in terms of their type of material, be so selected that desired damping effects are achievable by means of the molded bodies 20 when a compression of the receiving enclosure cross section 21 shown in FIG. 2 occurs following an impact load 22 upon the outer part 13 of the receiving enclosure 11 and the molded bodies are supported against one another. For example, the molded bodies 20 may be formed more or less resiliently from polystyrene, polyethylene, polypropylene as well as from plastic or less compliant materials wherein in the latter case the damping effects are brought about substantially by the movement of the molded bodies 20 relative to one another.

For the material layers 14 and 15 it is possible to use, in each case, material types of a fundamentally identical nature so long as the desired differing degrees of dimensional stability of the walls 16 and 17 are achieved. Thus, for example, a rigid PVC material may be used for the material layer 15 of the outer part 13 and a non-rigid PVC material for the material layer 14 of the inner part 12-Polyurethanes are also usable, in which case the differentiated dimensional stability between inner part and outer part may be achieved, for example, by different material thicknesses.

As is further clearly evident from FIG. 2, the material layers 14, 15, which form the inner part 12 and the outer part 13 respectively, are connected in a flange-like manner to one another in the outer and inner edge regions 23, 24 and 25, 26 respectively so as to form transition regions 27, 28. In the present case, the transition regions 27, 28 are produced in a thermobonding process, which is part of a thermal shaping process for producing the total molded part formed by the inner part 12 and the outer part 13 and is effected during the formation of the inner part and outer part by pressing together the molded part halves in the parting plane of a two-part mold. Such a process, whereby two material layers during the shaping to produce a one-piece total molded part are thermally bonded to one another in the parting plane of the mould, is known in the trade as a "twin-sheet" shaping process.

Figure 3:
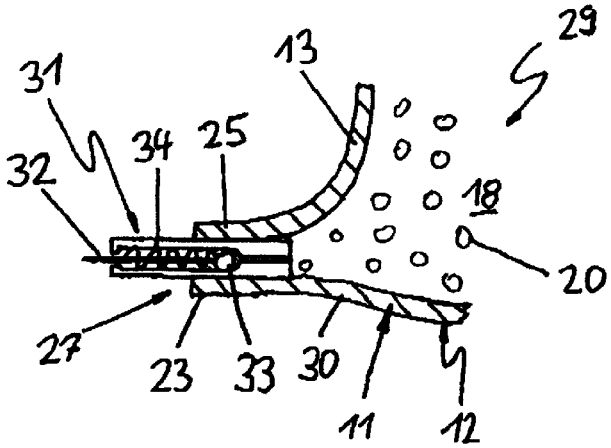
FIG. 3 a partial view of a head protection device which, compared to the head protection device shown in FIG. 2, is provided with a non-return valve.

FIG. 3 is used to illustrate a head protection device 29 designed as an alternative to the head protection device 10 shown in FIG. 2, wherein like the head protection device 10 shown in FIG. 2 the outer part 13 is formed from a dimensionally stable material layer 15 which, as has already been explained in detail, is used to realize the shell function integrated in the receiving enclosure 11. Unlike the head protection device 10 shown in FIG. 2, the head protection device 29 according to FIG. 3 however comprises a dimensionally compliant, flexible material layer 30 for forming the inner part 12. Situated at one point in the transition region 27 between an edge region 23 of the inner material layer 30 and the edge region 25 of the outer material layer 13 is a non-return valve device 31, which allows an evacuation of the interior space 18 of the receiving enclosure 11. Said evacuation may be effected automatically during positioning of the head protection device 29 on the head, whereby a yielding of the dimensionally compliant, in the present cast flexible material layer 30 in the direction of the outer material layer 15 forming the outer part 13 is effected. The non-return valve device 31 comprises a handle 32, which is connected to a valve body 33, and counter to the action of a valve spring 34 allows an aeration of the interior space 18 in cooperation with resilient restoring forces of the material layer 30.

Figure 4:
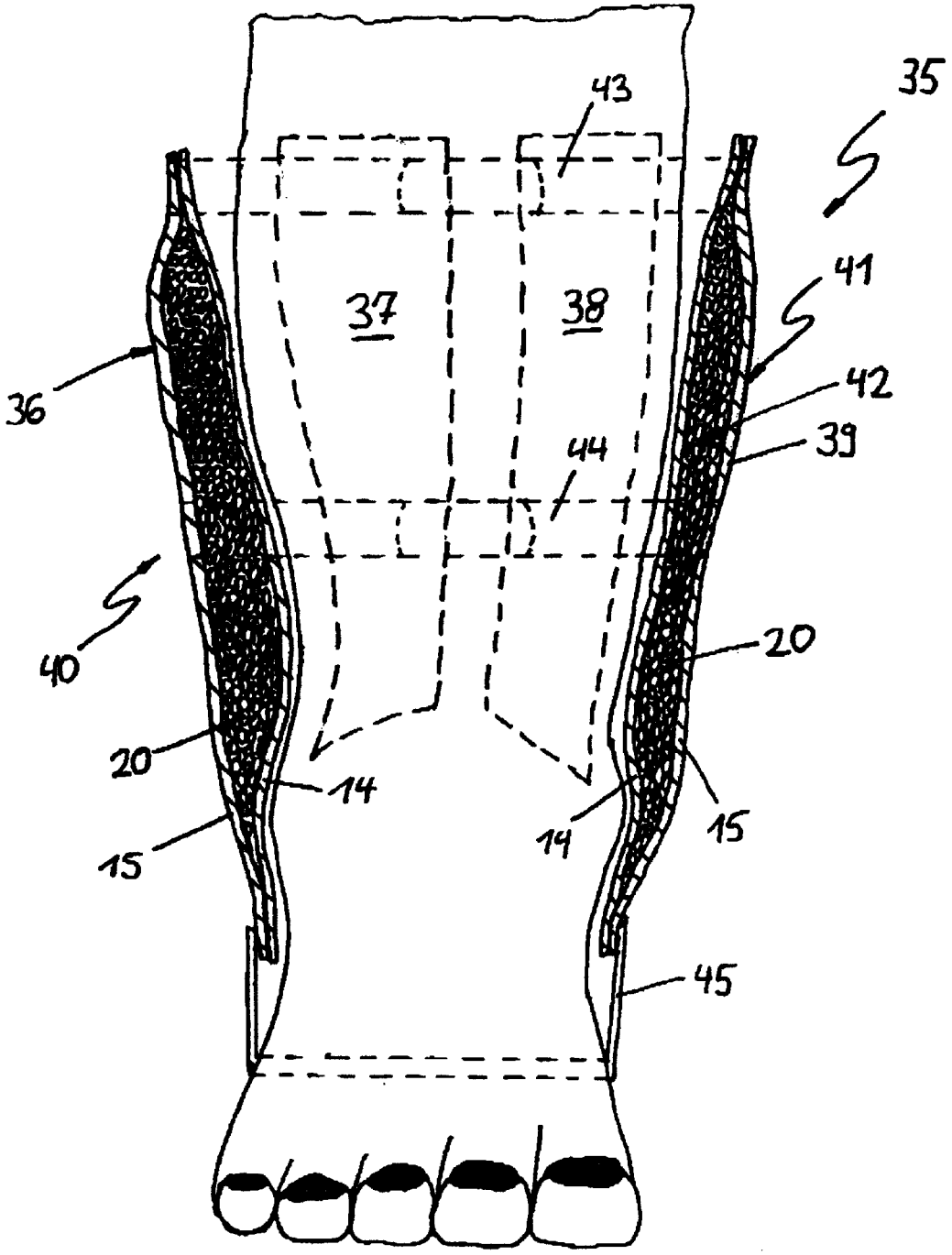
FIG. 4 a body protection/support device in an embodiment as a splint device.

FIG. 4 shows a body protection/support device in use as a splint device 35, having an, in the present case, multiple arrangement of support elements 36, 37, 38 and 39. The individual support elements 36 to 39 in the present case are of an identical type and, in accordance with the body protection/support device in the form of head protection device 10 shown in FIG. 2, comprise a receiving enclosure 40, which is formed by two material layers 14, 15 and in the application of the body protection/support device shown in FIG. 4 substantially has an elongate cushion format, wherein like the embodiment of the receiving enclosure 11 shown in FIG. 2 in the case of the—in FIG. 4—left support element 36 a receiving enclosure 40 is provided with a dimensionally stable material layer 15, which provides the support action needed for the splint application, and a dimensionally compliant material layer 14, which enables a snug fit against the body part. As in the case of the receiving enclosure 11 shown in FIG. 2, the receiving enclosure 40 is filled with molded bodies 20, which in terms of their resilient or plastic properties are so selected that the desired adaptation is achieved simultaneously with minimal impairment of the support action provided by the outer material layer 15.

Unlike the left support element 36, the—in FIG. 4 right support element 39 comprises an evacuable receiving enclosure 41 which, like the embodiment of the head protection device 10 shown in FIG. 3, is provided with a non-return valve device 31. The evacuable design of the support element 39 enables uniform compression of the molded bodies 20 disposed in an interior space 42 so that transfer of the support action of the dimensionally stable outer material layer 15 to the body part may be effected more directly and more effectively.

As was illustrated with the embodiment according to FIG. 4, it is possible for the splint device 35 to be composed of both non-evacuable support elements and evacuable support elements in order to produce the most advantageous configuration of the splint device 35 for each given application. Thus, in regions of the body part requiring less support than others, non-evacuable support elements may be used.

As is further clear from FIG. 4, in the splint device 35 the individual support elements 36 to 39 are arranged so as to be mechanically connected, this being achieved in the present case by Velcro strips 43, 44. For reliable positioning of the support elements, the latter may be connected at least partially by foot loops 45, which are passed through under the foot and connect the support elements to one another.

The receiving enclosures 40 and 41 used to form the support elements 36 to 39 in FIG. 4 and filled with molded bodies 20 may, if suitably dimensioned, also be used as mattresses (not shown here) of the type usable, for example, to prevent bedsores. In said case, the adaptation of the dimensionally compliant material layer 14 achieved with or without a vacuum is used for adaptation to the body of the patient lying on the mattress. The dimensionally stable material layer 50 in said case forms an outer, dimensionally stable frame, which eliminates the need to provide a suitable dimensionally stable frame for receiving the mattress. Thus, in the embodiment as a mattress also, by virtue of integrating the reinforcing "shell function" in a material layer an important advantage over known solutions is achieved.

While specific embodiments of the invention have been shown and described in detail to illustrate the application of the principles of the invention, it will be understood that the invention may be embodied otherwise without departing from such principles.

What is claimed is:

1. A body protection/support device for arrangement on a body part, the device comprising:

a receiving enclosure;

a molded body filling of individual molded bodies accommodated in a receiving space of said receiving enclosure, said receiving enclosure having a body part facing part facing the body part and an opposite part substantially remote from the body part, said body part icing part being connected to said opposite part to define said receiving space, said opposite part being relatively rigid compared to said to said body part facing part.

2. The body protection/support device according to claim 1, wherein the opposite part and the body part facing part of the receiving enclosure are formed from a common base material so as to verge continuously one into the other, and the opposite part and the body part facing part, in order to produce the differing degrees of rigidity, are provided with different material admixtures.

3. The body protection/support device according to claim 1, wherein the opposite part and the body part facing part of the receiving enclosure are formed from different materials.

4. The body protection/support device according to claim 3, wherein for forming the opposite part and the body part facing part at least two material layers are provided which, for forming the receiving enclosure, are connected to one another in a transition region.

5. The body protection/support device according to claim 4, that the material layers are cohesively connected to one another in a transition region.

6. The body protection/support device according to claim 5, wherein the material layers are connected to one another in the transition region by means of a thermobonded joint.

7. The body protection/support device according to claim 1, wherein at least the opposite part is provided-as a molded part with a dimensionally stable wall.

8. The body protection/support device according to claim 7, wherein the opposite part and the body part facing part are provided with a dimensionally stable wall.

9. The body protection/support device according to claim 7, wherein the opposite part has a dimensionally stable wall and the body part facing part is provided with a dimensionally compliant wall.

10. The body protection/support device according to claim 1, wherein the opposite part and the body part facing part form an, on the whole, cup-shaped receiving enclosure.

11. The body protection/support device according to claim 10, wherein the opposite part and the body part facing part are connected in a sealed manner with a vacuum established in the receiving space of the receiving.

12. The body protection/support device according to claim 1, wherein the opposite part and the body part facing part form an, on the whole, annular receiving enclosure.

13. The body protection/support device according to claim 1, wherein the body protection/support device is a splint device for use on a body part.

14. The body protection/support device according to claim 1, wherein the body protection/support device forms a head protector.

15. The body protection/support device according to claim 1, wherein the forming the opposite part and the body part facing part using different material treatments.

16. A method of protectioning/supporting a body part, the method comprising the steps of:

providing a receiving enclosure with a body part facing part connected to an opposite part to form a receiving space;

providing a molded body comprised of individual molded bodies;

filling the receiving space with the individual molded bodies such that the individual molded bodies are accommodated in the receiving enclosure;

forming the opposite part to be relatively rigid compared to the body part facing part;

applying the receiving enclosure with the molded body filling around the body part with the body part facing part in contact with or facing the body part.

17. The method according to claim 16, wherein the body protection/support device is used as a splint device applied on the body part.

18. The method device according to claim 16, wherein the body protection/support device is used as a head protector applied on the head of a user.

19. A body protection/support device for arrangement on a body part, the device comprising:

a first part having a first rigidity;

a second part having a second rigidity, said first part being connected to said second part to form a retaining element, each of said first part and said second part having an inner surface defining the extent of an inner retaining space of said retaining element, said first rigidity being greater than said second rigidity; and individual molded bodies accommodated in said receiving space of said receiving enclosure, said retaining element being applied to the body part with said second part having said second rigidity conforming to a shape of the body part and with the first part disposed opposite the second part and opposite the body part to form an outer shell.

* * * * *